US005265677A

United States Patent [19]

Schultz

[11] Patent Number: 5,265,677

[45] Date of Patent: Nov. 30, 1993

[54] REFRIGERANT-COOLED DOWNHOLE TOOL AND METHOD

[75] Inventor: Roger L. Schultz, Richardson, Tex.

[73] Assignee: Halliburton Company, Duncan, Okla.

[21] Appl. No.: 910,596

[22] Filed: Jul. 8, 1992

[51] Int. Cl.[5] ..... E21B 36/00; E21B 49/08; E21B 47/06

[52] U.S. Cl. ..... 166/302; 166/53; 166/57; 166/64; 62/259.2; 62/260; 175/50

[58] Field of Search ..... 166/302, 53, 57, 68, 166/65.1; 62/259.2, 260; 175/50

[56] References Cited

U.S. PATENT DOCUMENTS

| | | | |
|---|---|---|---|
| 2,033,560 | 3/1936 | Wells | 166/1 |
| 3,004,601 | 10/1961 | Bodine | 166/57 X |
| 3,167,653 | 1/1965 | Rumble et al. | 250/71.5 |
| 3,194,315 | 7/1965 | Rogers | 166/57 |
| 3,357,490 | 12/1967 | Holmes | 166/53 |
| 3,382,923 | 5/1968 | Parker et al. | 166/39 |
| 3,434,534 | 3/1969 | Hollabaugh | 166/53 |
| 3,882,937 | 5/1975 | Robinson | 166/267 |
| 4,375,157 | 3/1983 | Boesen | 62/514 R |
| 4,378,850 | 4/1983 | Barrington | 166/373 |
| 4,440,219 | 4/1984 | Engelder | 166/57 |
| 4,796,699 | 1/1989 | Upchurch | 166/250 |
| 4,805,698 | 2/1989 | Baugh et al. | 166/272 |
| 4,856,595 | 8/1989 | Upchurch | 166/374 |
| 4,866,607 | 9/1989 | Anderson et al. | 364/422 |
| 4,872,507 | 10/1989 | Ronco, Sr. et al. | 166/57 |
| 4,876,450 | 10/1989 | Montgomery | 250/261 |
| 4,896,722 | 1/1990 | Upchurch | 166/250 |
| 4,915,168 | 4/1990 | Upchurch | 166/250 |
| 4,971,160 | 11/1990 | Upchurch | 175/4.54 |
| 5,202,194 | 4/1993 | Van Berg | 175/104 X |

*Primary Examiner*—Stephen J. Novosad

*Attorney, Agent, or Firm*—Tracy W. Druce; E. Harry Gilbert, III

[57] ABSTRACT

A downhole tool comprises an apparatus including an electrical member and a cooling system to maintain the electrical member within a rated temperature operating range. The cooling system includes a container holding a refrigerant. The cooling system also includes heat transfer elements for conducting refrigerant from the container in proximity to the electrical member so that a temperature adjacent the electrical member is less than ambient well bore temperature and preferably less than the maximum of the rated temperature operating range. The cooling system further includes a device for moving refrigerant from the container and through the heat transfer elements in response to pressure in the well bore. In a preferred embodiment, the refrigerant is recycled through the heat transfer circuit back to the container. A method of reducing temperature adjacent an electrical portion of a downhole tool comprises: discharging a refrigerant from a chamber in the downhole tool in response to pressure of a fluid in a well so that refrigerant flows from the chamber through an expansion valve and an evaporator; and transferring to refrigerant passing through the evaporator heat from adjacent the electrical portion of the downhole tool.

31 Claims, 3 Drawing Sheets

REFRIGERANT-COOLED DOWNHOLE TOOL AND METHOD

BACKGROUND OF THE INVENTION

This invention relates generally to a downhole tool and method providing for cooling an electrical portion of the tool. In a particular implementation the downhole tool is for testing pressure buildup and drawdown in a high temperature oil or gas well, and the method is for reducing temperature adjacent the electrical portion of the tool.

Electrical members, such as microprocessors and batteries, have been used or proposed for use in downhole tools that can perform various functions in an oil or gas well. For example, there is a downhole memory gauge, comprising a microprocessor, integrated circuit memory, and batteries, that can be lowered into a well to sense and record downhole pressures and temperatures. As another example, there have been disclosures of downhole tools used in drillstem tests and production tests during which valves in the downhole tools are controlled by electrical circuits in the downhole tools to open and close and thereby flow and shut-in the wells.

A limitation on the use of electrical components in a downhole tool is high temperature in the well. That is, electrical components are typically rated for reliable operation within a specified operating temperature range; outside such a range, unreliable or inefficient operation results. "High temperature" as used herein and in the claims encompasses temperatures outside such a predetermined operating temperature range. For example, particular electrical components might be rated for operation up to 350° F. whereas a high temperature well might have temperatures up to 400° F. or higher.

Although insulating or pre-cooling the electrical members before lowering them into the well might provide some protection against high temperatures in wells, any such protection will likely be only temporary and too short-lived if the tool is to be used for any extended period of time Thus, there is the need for a downhole tool and method by which extended protection against high downhole temperatures can be provided for one or more electrical members in the downhole tool. Preferably, such a tool and method should actively use a refrigeration cycle that is powered by pressure differentials in the well. Furthermore, such a tool and method should also preferably provide for extended use by recycling refrigerant through the refrigeration cycle. These needs particularly exist with regard to a downhole flow control tool such as a testing tool wherein the one or more electrical members preferably include a remotely responsive microprocessor adapted to operate a valve disposed in a flow path of a housing of the downhole tool so that a pressure buildup and drawdown test can be reliably performed in a high temperature well.

SUMMARY OF THE INVENTION

The present invention overcomes the above-noted and other shortcomings of the prior art and meets the aforementioned needs by providing a novel and improved downhole tool and method providing for cooling an electrical portion of the tool. The present invention allows operation of one or more electrical members in high temperature wells where temperatures exceed the maximum temperatures for which the electrical members are rated. The present invention also allows for more efficient operation of the electrical portion of the tool by keeping it cooled.

As to a particular downhole tool, the present invention comprises: a housing having a flow path defined therein for communicating the housing with an oil or gas well; a valve disposed in the housing to control fluid flow through the flow path; valve operating means, connected to the valve, for operating the valve, the valve operating means including electrical means for generating one or more local control signals to operate the valve both in response to one or more remote control signals generated at the surface of the oil or gas well and received down in the well by the valve operating means and in response to the electrical means being maintained down in the well at a temperature within a predetermined temperature operating range; and cooling means for reducing temperature adjacent the electrical means down in the well so that the electrical means is maintained at a temperature within the predetermined temperature operating range. In a particular implementation, the flow path communicates with a flow path of a tubing string in response to the housing being connected to the tubing string, and the electrical means includes a microprocessor adapted for responding to the one or more remote control signals and for generating the one or more local control signals to perform a pressure buildup and drawdown test.

As to a particular cooling means, the present invention provides a downhole tool, comprising: an apparatus including an electrical member; container means, connected to the apparatus, for holding a refrigerant in the downhole tool; heat transfer means, connected to the container means, for conducting refrigerant from the container means in proximity to the electrical member so that a temperature adjacent the electrical member is less than ambient well bore temperature; and means, responsive to pressure in a well bore, for moving refrigerant from the container means through the heat transfer means.

In a preferred embodiment, the heat transfer means includes a valve, and the downhole tool further comprises means for operating the valve in response to a downhole temperature. In a particular implementation, the means for operating the valve includes a temperature sensor disposed in heat sensing proximity to the electrical member.

In a preferred embodiment, the heat transfer means is connected to the container means so that refrigerant moved through the heat transfer means returns to the container means. In a particular implementation, movement is through the following elements of the heat transfer means: condenser means, connected to the container means, for converting a vaporized refrigerant to a liquified refrigerant; expansion means, connected to the condenser means, for converting liquified refrigerant to a liquid/vapor refrigerant mixture; and evaporator means, connected to the expansion means and the container means, for converting liquid/vapor refrigerant mixture to spent refrigerant vapor in response to heat transfer to the evaporator means.

In a preferred embodiment, the container means includes a first chamber, a second chamber, and a third chamber, the first chamber having refrigerant disposed therein and the second chamber having biasing means disposed therein and the third chamber adapted to receive well bore fluid. In a particular implementation, the biasing means is pressurized gas.

The present invention also provides a method of reducing temperature adjacent an electrical portion of a downhole tool, comprising: discharging a refrigerant from a chamber in the downhole tool in response to pressure of a fluid in a well so that refrigerant flows from the chamber through an expansion valve and an evaporator; and transferring to refrigerant passing through the evaporator heat from adjacent the electrical portion of the downhole tool.

In a preferred embodiment, the discharged refrigerant also flows through a condenser for transferring heat from refrigerant passing through the condenser; and after passing through the evaporator, the discharged refrigerant returns to the chamber for reuse.

In a preferred embodiment, discharging a refrigerant includes moving a piston within the chamber of the downhole tool. In a particular methodology, the piston moves within the downhole tool against refrigerant in the chamber and against a pressurized gas in a second chamber of the downhole tool In a preferred embodiment, discharging a refrigerant includes opening the expansion valve in response to a temperature adjacent the electrical portion of the downhole tool exceeding a predetermined magnitude Therefore, from the foregoing, it is a general object of the present invention to provide a novel and improved downhole tool and method providing for cooling an electrical portion of the tool. Other and further objects, features and advantages of the present invention will be readily apparent to those skilled in the art when the following description of the preferred embodiments is read in conjunction with the accompanying drawings.

BRIEF DESCRIPTION OF THE DRAWINGS

FIG. 3 is a schematic diagram of another preferred embodiment of a cooling system included in a downhole tool represented in FIG. 1.

DETAILED DESCRIPTION OF PREFERRED EMBODIMENTS

During the course of drilling an oil or gas well, the borehole is filled with a fluid known as drilling fluid or drilling mud. One of the purposes of this drilling fluid is to contain in intersected formations any formation fluids which may be found there To contain these formation fluids, the drilling mud is weighted with various additives so that the hydrostatic pressure of the mud at the formation depth is sufficient to maintain the formation fluids within the formation without allowing it to escape into the borehole Drilling fluids and formation fluids can all be generally referred to as well fluids.

When it is desired to test the production capabilities of the formation, a string of interconnected pipe sections and downhole tools referred to as a testing string is lowered into the borehole to the formation depth and the formation fluid is allowed to flow into the string in a controlled testing program.

Sometimes, lower pressure is maintained in the interior of the testing string as it is lowered into the borehole This is usually done by keeping a formation tester valve in the closed position 15 near the lower end of the testing string When the testing depth is reached, a packer is set to seal the borehole, thus closing the formation from the hydrostatic pressure of the drilling fluid in the well annulus above the packer. The formation tester valve at the lower end of the testing string is then opened and the formation fluid, free from the restraining pressure of the drilling fluid, can flow into the interior of the testing string.

At other times the conditions are such that it is desirable to fill the testing string above the formation tester valve with liquid as the testing string is lowered into the well. This may be for the purpose of equalizing the hydrostatic pressure head across the walls of the test string to prevent inward collapse of the pipe and/or this may be for the purpose of permitting pressure testing of the test string as it is lowered into the well.

The well testing program includes time intervals of formation flow and time intervals when the formation is closed in. Pressure recordings are taken throughout the program for later analysis to determine the production capability of the formation. If desired, a sample of the formation fluid may be caught in a suitable sample chamber that communicates with the well through a sampler valve.

At the end of the well testing program, a circulation valve in the test string is opened, formation fluid in the testing string is circulated out, the packer is released, and the testing string is withdrawn.

Figure 1:
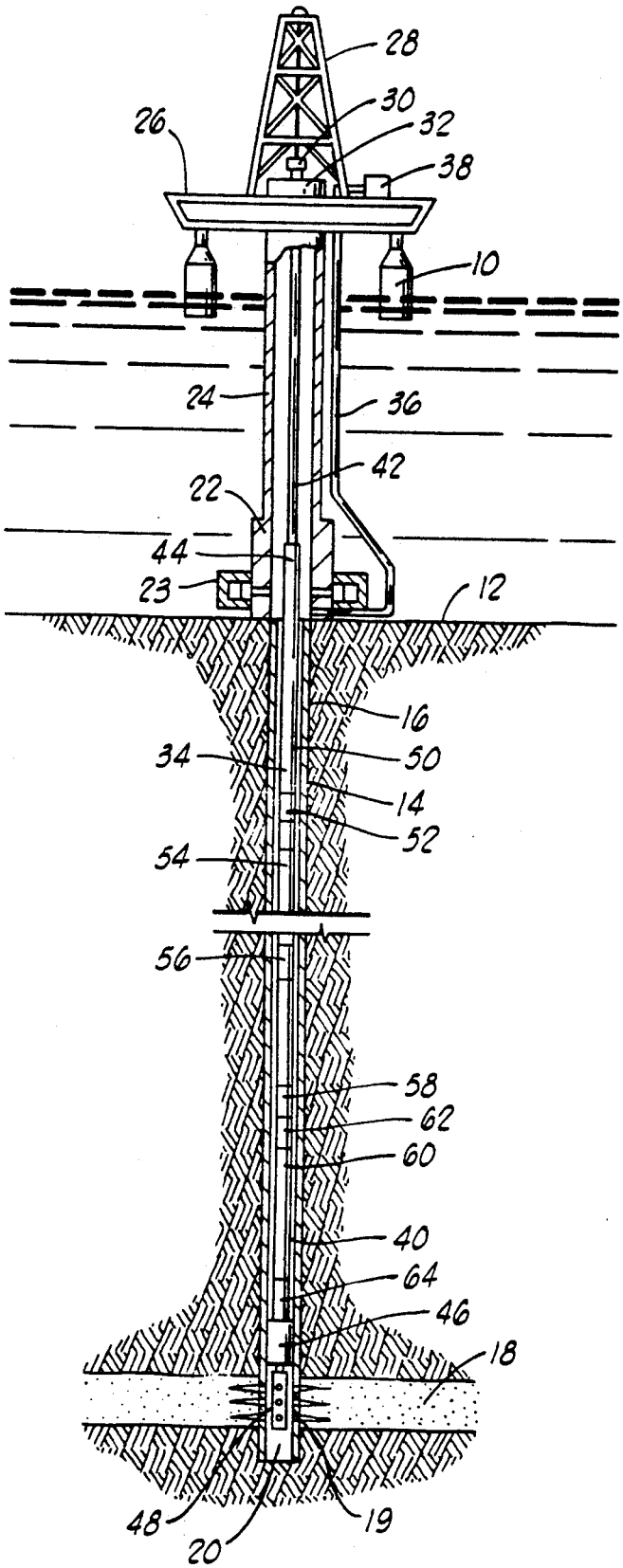
FIG. 1 is a schematic elevational view of a typical well test string in which the present invention can be used.

A typical arrangement for conducting a drill stem test offshore is shown in FIG. 1. In one aspect, the present invention is directed to an actively cooled electrical downhole tool for reliably performing this or other types of remotely operated downhole flow control operations in high temperature wells (whether offshore or on land). In another aspect, the present invention is directed to a general type of electrical downhole tool including a particular cooling means which can be used in other oil or gas well applications with other types of downhole tools.

The arrangement of the offshore system includes a floating work station 10 stationed over a submerged well site 12. The well comprises a well bore 14, which typically but not necessarily is lined with a casing string 16 extending from the submerged well site 12 to a subterranean formation 18.

The casing string 16 includes a plurality of perforations 19 at its lower end. These provide communication between the formation 18 and a lower interior zone or annulus 20 of the well bore 14.

At the submerged well site 12 is located the well head installation 22 which includes blowout preventer mechanisms 23. A marine conductor 24 extends from the well head installation 22 to the floating work station 10. The floating work station 10 includes a work deck 26 which supports a derrick 28. The derrick 28 supports a hoisting means 30. A well head closure 32 is provided at the upper end of the marine conductor 24. The well head closure 32 allows for lowering into the marine conductor 24 and into the well bore 14 a formation testing string 34 which is raised and lowered in the well by the hoisting means 30. The testing string 34 may also generally be referred to as a tubing string or a tool string.

A supply conductor 36 is provided which extends from a hydraulic pump 38 on the deck 26 of the floating station 10 and extends to the well head installation 22 at a point below the blowout preventer 23 to allow the pressurizing of a well annulus 40 defined between the testing string 34 and the well bore 14 or the casing 16 if present.

The testing string 34 includes an upper conduit string portion 42 extending from the work deck 26 to the well head installation 22. A subsea test tree 44 is located at the lower end of the upper conduit string 42 and is landed in the well head installation 22.

The lower portion of the formation testing string 34 extends from the test tree 44 to the formation 18. A packer mechanism 46 isolates the formation 18 from the fluids in the well annulus 40. Thus, an interior or tubing string bore of the tubing string 34 is isolated from the upper well annulus 40 above packer 46 unless other communication openings are provided Also, the upper well annulus 40 above packer 46 is isolated from the lower well zone 20 which is often referred to as the rat hole 20.

A perforated tail piece 48 provided at the lower end of the testing string 34 allows fluid communication between the formation 18 and the interior of the tubular formation testing string 34.

The lower portion of the formation testing string 34 further includes intermediate conduit portion 50 and a torque transmitting pressure and volume balanced slip joint means 52. An intermediate conduit portion 54 is provided for imparting packer setting weight to the packer mechanism 46 at the lower end of the string.

It is many times desirable to place near the lower end of the testing string 34 a circulation valve 56. Below circulating valve 56 there may be located a combination sampler valve section and reverse circulation valve 58. Also near the lower end of the formation testing string 34 is located a formation tester valve 60. Immediately above the formation testing valve 60 there may be located a drill pipe tester valve 62. These valves are mounted in one or more housings connected in the testing string 34 as shown in FIG. i and as known in the art so that the valves control fluid flow through their respective flow path(s) defined in their respective housing(s) for communicating the housing(s) with the well. The flow path of at least the formation testing valve 60 communicates with a flow path through the testing string 34 when the string is assembled as illustrated in FIG. 1.

A pressure recording device 64 is located below the formation tester valve 60. The pressure recording device 64 is preferably one which provides a full opening passageway through the center of the pressure recorder to provide a full opening passageway through the entire length of the formation testing string.

Non-limiting examples of specific valve-containing electrical downhole flow-control tools into which it is contemplated the general cooling means of the present invention can be incorporated include those disclosed in U.S. Pat. No. 4,378,850 to Barrington and the following U.S. Pat. Nos. to Upchurch: 4,796,699; 4,856,595; 4,896,722; 4,915,168; and 4,971,160; all of which are incorporated herein by reference. The general cooling means can be implemented by the particular cooling systems disclosed hereinbelow, which particular cooling systems in conjunction with an electrical downhole tool of any suitable type constitute another aspect of the present invention. Another non-limiting example of a specific downhole tool into which it is contemplated the particular cooling means of the present invention can be incorporated is disclosed in U.S. Pat. No. 4,866,607 to Anderson et al., incorporated herein by reference.

The Barrington patent and the Upchurch patents disclose apparatus that include one or more flow control valves such as can be used for flow testing a well as described above. The Anderson et al. patent discloses an apparatus that senses downhole conditions and records data about the sensed conditions. A common feature of these exemplary tools is that they all include one or more electrical members typically rated for operation within a predetermined operating temperature range as known in the art. The maximum of any such range is typically greater than temperatures encountered in many oil or gas wells, but it is typically less than temperatures encountered in at least some oil or gas wells where use of the downhole tools operated by such electrical members is desired. Non-limiting examples of such temperature-sensitive electrical members include microprocessors, other integrated circuit devices, and batteries.

Although the electrical members are not identified in FIG. 1, they are part of the testing string 34 and downhole tools included therein. At least one assemblage of such electrical members is depicted as electrical circuit(s) 90 in FIG. 2. Referring to the examples of the Barrington and Upchurch patents, wherein downhole tools having at least a respective housing and flow control valve are disclosed, such electrical elements are part of valve control means. These electrical elements provide electrical means for generating one or more local control signals to operate the valve both in response to one or more remote control signals generated at the surface of the oil or gas well and received down in the well by the valve operating means and in response to the electrical means being maintained down in the well at a temperature within a predetermined temperature operating range. Such electrical means typically cyclically operates the flow control valve to close and open so that the pressure buildup and drawdown intervals are thereby defined. Preferably this is achieved using an integrated circuit microprocessor adapted for responding to the one or more remote control signals and for generating the one or more local control signals to perform the pressure buildup and drawdown test. Such electrical members generate heat during their operation as well as being sensitive to the cumulative environmental temperature in which they operate.

Figure 2:
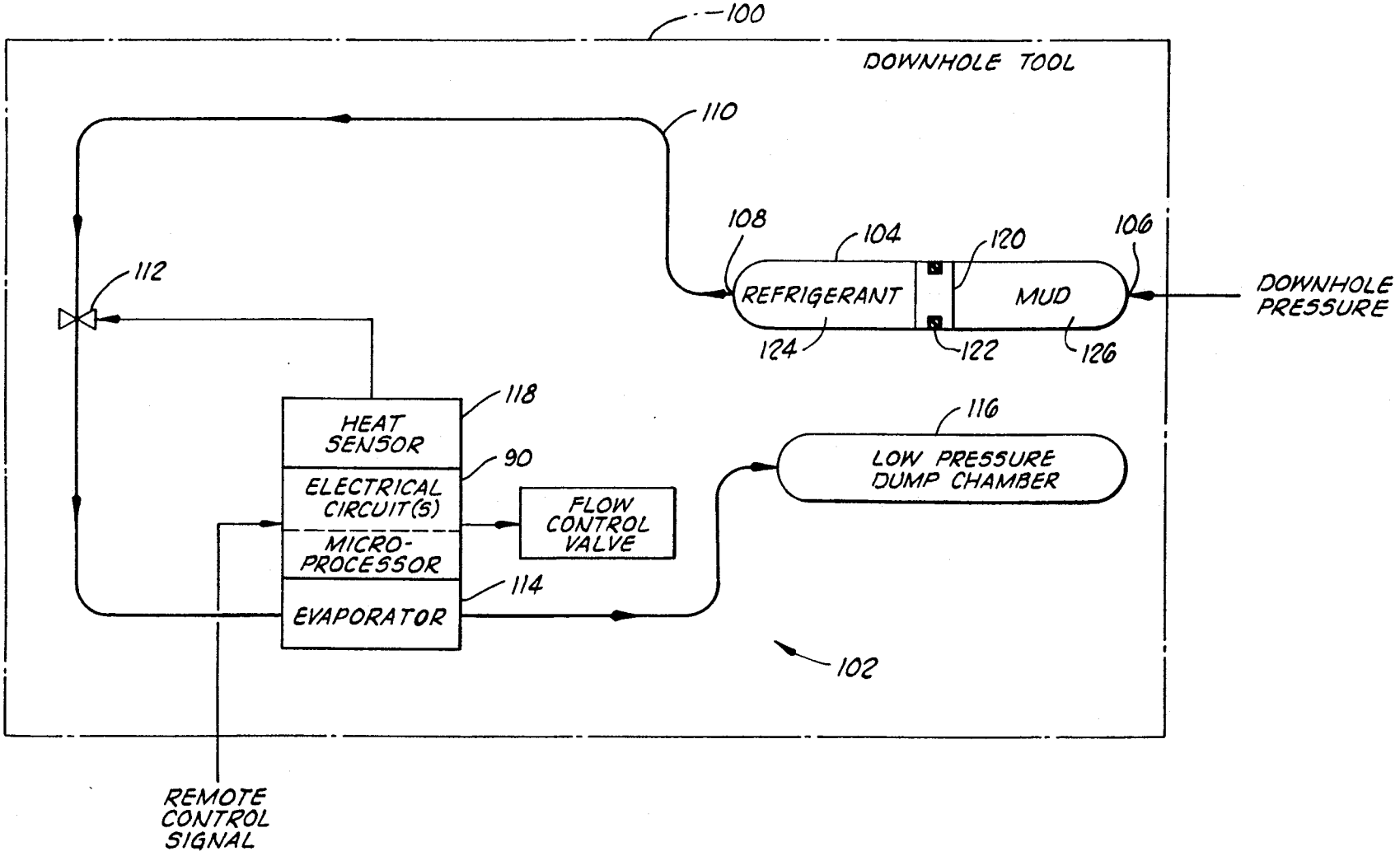
FIG. 2 is a schematic diagram of a preferred embodiment of a cooling system included in a downhole tool represented in FIG. 1.
Figure 9:
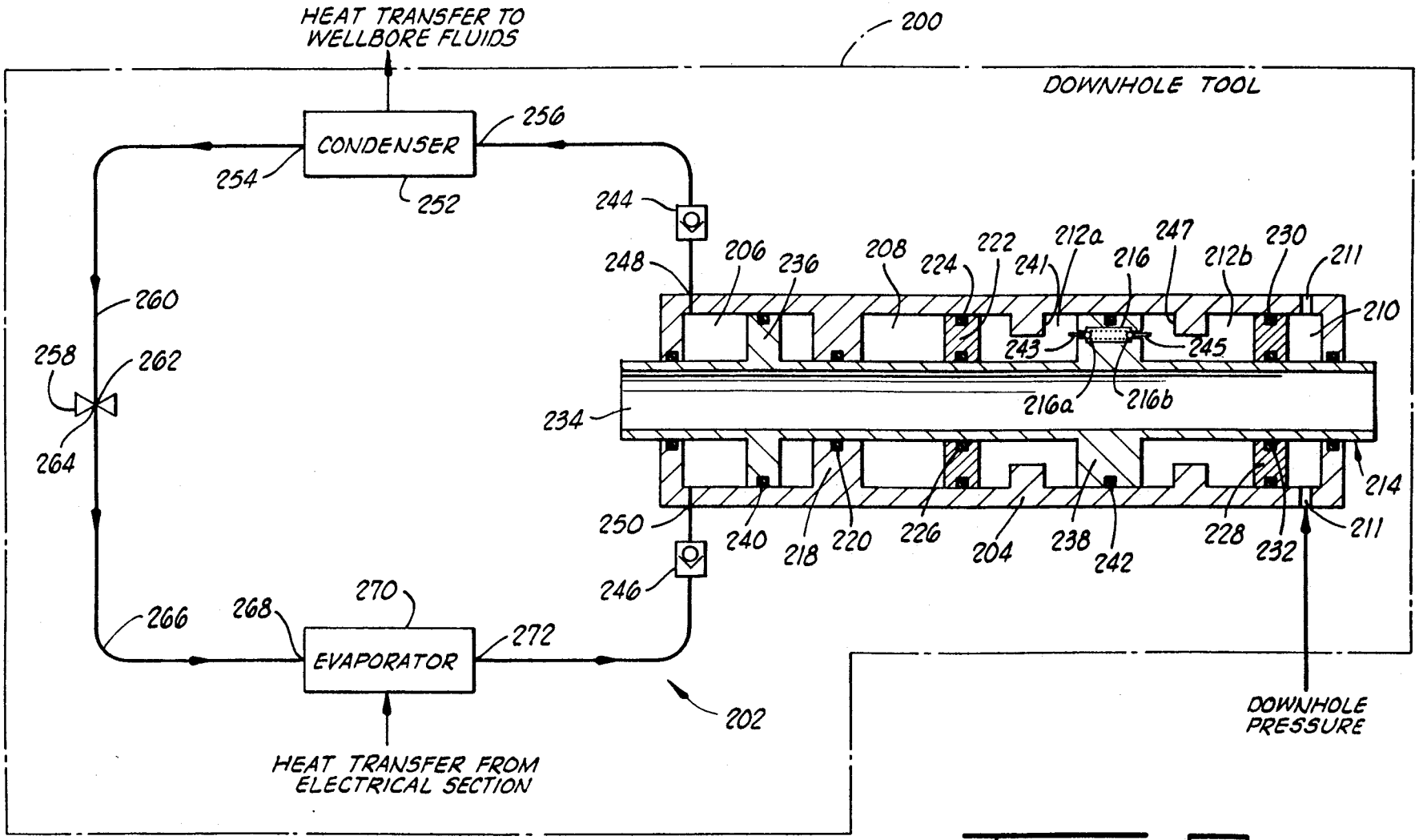

The electrical means 90 identified in FIG. 2 is part of a downhole tool 100. Although the downhole tool 100 can include other elements as known in the art and as illustrated in the aforementioned patents, the downhole tool also includes a cooling system 102 of the present invention. The cooling system generally provides means for reducing temperature adjacent the electrical means down in the well so that the electrical means is maintained at a temperature within the predetermined temperature operating range.

The cooling system 102 of the downhole tool 100 includes a container 104 for holding a refrigerant in the downhole tool 100. The container 104 is defined within the structure of the downhole tool 100 or as a distinct element therein (e.g., as a discrete canister or the like). In any event it is incorporated into the downhole tool 100 and as such it is at least in this manner connected to the apparatus comprising the electrical member or members 90.

The container 104 has an inlet 106 through which well bore fluid and pressure are received. The container 104 has an outlet 108 through which refrigerant stored in the container 104 is discharged. The refrigerant in the preferred embodiment of FIG. 2 is a high pressure liquid, such as one of the many fluorine refrigerants or water charged to the container 104 at a pressure sufficient to be in a liquid state at the surface temperature.

The cooling system 102 further includes heat transfer means for conducting refrigerant from the container 104 in proximity to the electrical means 90 so that a temperature adjacent the electrical means is less than ambient well bore temperature (and more specifically, is within the predetermined temperature operating range for the electrical means). The heat transfer means is connected to the container 104 via a conduit 110 coupled to the outlet 108. The heat transfer means of the cooling system 102 includes an expansion valve 112 and an evaporator 114 serially connected in line between the conduit 110 and a low pressure dump chamber 116 defined or contained within the downhole tool 100.

The expansion valve 112 and the evaporator 114 provide in a manner known in the art an enlarged flow volume relative to the conduit 110 so that the high pressure liquid refrigerant is converted to a lower pressure liquid/vapor mixture which absorbs heat from the electrical means 90 as the mixture flows through the evaporator 114. This further converts the refrigerant into a relatively low pressure vapor that is received in the dump chamber 116. This heat transfer reduces or maintains the temperature adjacent the electrical means 90 below what it would otherwise be without such heat transfer.

Although the expansion valve 112 can be any suitable type, the type illustrated in FIG. 2 is one that is normally closed unless opened by a suitable operating force controlled by means for operating the expansion valve 112 in response to a downhole temperature, preferably a temperature adjacent the electrical means 90. As shown in FIG. 2, this means for operating includes a temperature sensor 118 disposed in heat sensing proximity to the electrical means 90. When a predetermined temperature is sensed by the sensor 118, an electrical signal from the sensor triggers an associated circuit to generate the operating force, such as including an electrical current flowing through a solenoid that moves and thereby unseats a valve element of the valve 112. The predetermined temperature at which the sensor 118 causes the expansion valve 112 to open is preferably a temperature within the known or rated operating temperature range of the electrical means 90 so that refrigerant flow is permitted before the temperature adjacent the electrical means 90 exceeds the upper limit of such range.

When the expansion valve 112 is open, refrigerant is moved from the container 104 through the heat transfer means in response to pressure in the well bore in which the downhole tool 100 is used. The means for effecting this movement includes a piston 120 slidably disposed in the container 104. The piston 120 carries a sealing member 122 to isolate a variable capacity chamber 124 from a variable capacity chamber 126 of the container 104. The chamber 124 contains the refrigerant, and the chamber 126 receives well bore fluid (labeled "mud" in FIG. 2) at the downhole pressure. For proper operation, the pressure of the refrigerant is less than the downhole pressure so that a pressure differential across the piston 120 exists to drive the piston 120 to the left as viewed in FIG. 2 when the valve 112 is open, thereby discharging refrigerant from the chamber 124 and moving it through the heat transfer means to obtain the cooling effect described above.

The cooling system 102 of the downhole tool 100 just described is not reusable once the refrigerant is depleted from the container 104 unless the downhole tool 100 is removed from the well and additional refrigerant is charged to the container 104. A cooling system that is reusable without requiring such removal and additional refrigerant is shown in FIG. 3.

Represented in FIG. 3 is a downhole tool 200 of any suitable type as described above but including a regenerative or recycling cooling system 202.

The cooling system 202 includes a container 204 within the downhole tool 200. A particular implementation of the container 204 as shown in FIG. 3 has a first chamber 206, a second chamber 208, a third chamber 210 and a fourth chamber 212. The first chamber 206 contains refrigerant, preferably a high pressure vapor such as one of the many fluorine refrigerants charged to the chamber 206 at about 50 to about 300 pounds per square inch (psi). Disposed in the second chamber 208 is a biasing means, such as a pressurized gas (e.g., nitrogen charged into the chamber 208 at about 1,000 to about 10,000 psi depending on hydrostatic pressures in the well). The biasing means provides a biasing force against a piston 214 in opposition to pressure of the well bore fluid communicated to the third chamber 210 such as through inlet port(s) 211 defined in the container 204. The fourth chamber, comprising regions **212*a*, 212*b* communicating through a check valve 216 carried on the piston 214**, contains a fluid, such as oil.

The first and second chambers 206, 208 are separated by an annular wall 218 of the container 204. A sealing member 220 seals between the wall 218 and the piston 214.

The second and fourth chambers 208, **212*a* are separated by a movable annular divider or piston 222 carrying seals 224, 226 to seal against the container 204 and the piston 214**, respectively.

The third and fourth chambers 210, **212*b* are separated by a movable annular divider or piston 228 carrying seals 230, 232 to seal against the container 204 and the piston 214**, respectively.

The piston 214 is slidably disposed in the container 204 and extends through all of the chambers 206–212. The piston 214 includes a cylindrical axial mandrel or main body portion 234 from which annular portions 236, 238 extend radially outwardly. The portion 236 carries a sealing member 240 that seals against the container 204 within the thereby subdivided chamber 206. The portion 238 carries a sealing member 242 that seals against the container 204 within the thereby subdivided chamber 212.

In response to well bore pressure received in the chamber 210 and acting against the divider 228 being greater than the pressure of the gas in the chamber 208, the piston 214 moves to the left as viewed in FIG. 3. The limit to this movement is defined by the piston's annular portion 238 abutting a stop shoulder 241 of the container 204. Prior to such limit being reached, the shoulder 241 engages an actuating member 243 of check valve **216*a* upon sufficient leftward movement of the piston 214; this opens the normally closed spring-biased check valve 216*a*. This allows fluid and pressure communication through the check valves 216 into the chamber 212*a* to permit further pressurization of the gas in the chamber 208 even after the piston 214 has reached its limit of movement. Such further pressurization occurs by increasing or continuing to increase the downhole pressure above hydrostatic pressure (such as by pumping). Such pressure is communicated through the open check valves 216 to act against the divider 222 and thereby further compress the gas in the chamber 208 to a supercharged state greater than hydrostatic pressure of fluid in the well annulus. During this phase or part of one reciprocation of the piston 214, leftward (as viewed in FIG. 3) movement of the annular portion 236 of the piston 214 discharges refrigerant from the chamber 206 through a check valve 244 into the heat transfer means of the cooling system 202. The check valve 244 is connected to a refrigerant chamber outlet port 248 defined in the container 204**.

When the pressure applied to the well annulus from the surface is released, the supercharged gas in the chamber 208 pushes the divider 222 to the right, exerting a force which closes the spring-biased check valve **216*b* if it is not already closed. This force also moves the piston 214 to the right as viewed in FIG. 3, thereby reducing the pressure in the chamber 206 so that a check valve 246 opens and refrigerant returns to the chamber 206 from the heat transfer circuit. The check valve 246 is connected to a refrigerant chamber inlet port 250 defined in the container 204. Rightward (as viewed in FIG. 3) movement of the piston 214 can continue until a stem 245 of the check valve 216*b* and the annular portion 238 of the piston 214 abut a stop shoulder 247 of the container 204. This phase or part of one reciprocation of the piston 214** resets the system so that it can recycle refrigerant through the heat transfer means when control pressure is again applied to the well annulus from the surface.

During a reciprocation of the piston 214 as just described, the respective volumes of the chambers 208, 210 and 212 automatically adjust by means of movement of the dividers 222, 228.

Connected between the check valves 244, 246 is the heat transfer means for transferring heat from adjacent the electrical means of the particular downhole tool 200 in which the cooling system 202 is used. In the cooling system 202, the heat transfer means also transfers heat from the refrigerant, preferably into the well bore fluid. This allows the refrigerant to be reused.

As shown in FIG. 3, the heat transfer means of this embodiment includes a condenser 252 having a flow outlet 254 and further having a flow inlet 256, which inlet 256 is connected to the container 204 in communication with the chamber 206 via the check valve 244. The condenser 252 converts high pressure vaporized refrigerant received from the chamber 206 through the check valve 244 to high pressure liquified refrigerant provided through the outlet 254 of the condenser 252. This occurs in response to heat transfer from the refrigerant through the condenser 252 to a well bore fluid or other suitable heat sink.

Connected to the outlet 254 of the condenser 252 and included within the heat transfer means of the cooling system 202 is an expansion valve 258. The outlet 254 of the condenser 252 is connected through a conduit 260 to an inlet 262 of the expansion valve 258. As the refrigerant entering the inlet 262 expands through an enlarged outlet 264 of the expansion valve 258, the refrigerant is further cooled as known in the art. Thus, passing the condensed refrigerant through the expansion valve 258 converts the condensed, liquified refrigerant to a liquid/vapor refrigerant mixture.

This mixture flows through a conduit 266 to an inlet 268 of an evaporator 270 having an outlet 272 connected to the check valve 246 so that the evaporator 270 is in communication with the chamber 206 of the container 204. As in the embodiment of FIG. 2, the evaporator 270 is disposed for transferring heat from adjacent the electrical means of the downhole tool 200 to the refrigerant flowing through the evaporator 270. This heat transfer converts the liquid/vapor refrigerant mixture from the expansion valve 258 to spent refrigerant vapor. The spent refrigerant is returned to the chamber 206 through the check valve 246 for reuse in response to subsequent compression by the piston 214. The circulation of the refrigerant in its various phases is achieved by this compression so that the piston 214 provides means for moving the refrigerant from the chamber 206 through the condenser 252, expansion valve 258 and evaporator 270 and back into the chamber 206 in response to pressure of fluid in the well communicated into chamber 210.

Implementation of the expansion valve 258 and the evaporator 270 can be the same as described above with reference to the embodiment of FIG. 2, except that the expansion valve 258 is not shown as being operated in response to sensed temperature (although it can be). Instead, the expansion valve 258 may be spring biased closed or otherwise operated to open or be open as desired. The condenser can be of similar design to the evaporator (e.g., a coiled tubing) but for any desired or required difference in flow diameter as may be needed for effecting the refrigeration cycle.

The embodiments of the downhole tools 100, 200 described with reference to FIGS. 2 and 3 can be used to perform the method of the present invention. In accordance with the foregoing descriptions, this method comprises: discharging a refrigerant from a chamber (124, 206) in the downhole tool (100, 200) in response to pressure of fluid in a well so that refrigerant flows from the chamber (124, 206) through an expansion valve (112, 258) and an evaporator (114, 270); and transferring to refrigerant passing through the evaporator (114, 270) heat from adjacent the electrical portion of the downhole tool (100, 200). The refrigerant is discharged from the respective chamber by the piston (120, 214) moving in response to pressure from the well bore (via inlets 106, 211).

Described with reference to the FIG. 2 embodiment, but also adaptable to the FIG. 3 embodiment, the step of discharging a refrigerant includes opening the expansion valve (112, 258) in response to temperature adjacent the electrical portion of the downhole tool (100, 200) exceeding a predetermined magnitude as explained above.

In the recycling embodiment described with reference to FIG. 3, discharged refrigerant also flows through a condenser (252) for transferring heat from refrigerant passing through the condenser; and after passing through the evaporator (270), discharged refrigerant returns to the chamber (206) for reuse. Also described with reference to the FIG. 3 embodiment, but adaptable to the FIG. 2 embodiment, is the particular container and piston assembly wherein discharging a refrigerant includes moving a piston (214) within the downhole tool against refrigerant in the chamber (206) and against a pressurized gas in a second chamber (208) of the downhole tool.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A downhole tool, comprising:
an apparatus including an electrical member;
container means, connected to said apparatus, for holding a refrigerant in said downhole tool;
heat transfer means, connected to said container means, for conducting refrigerant from said container means in proximity to said electrical member so that a temperature adjacent said electrical member is less than ambient well bore temperature; and
means, responsive to pressure in a well bore, for moving refrigerant from said container means through said heat transfer means.

2. A downhole tool as defined in claim 1, wherein:
said heat transfer means includes a valve; and
said downhole tool further comprises means for operating said valve in response to a downhole temperature.

3. A downhole tool as defined in claim 2, wherein said means for operating said valve includes a temperature sensor disposed in heat sensing proximity to said electrical member.

4. A downhole tool as defined in claim 1, wherein said heat transfer means is connected to said container means so that refrigerant moved through said heat transfer means returns to said container means.

5. A downhole tool as defined in claim 1, wherein said heat transfer means includes:
condenser means, connected to said container means, for converting a vaporized refrigerant to a liquified refrigerant;
expansion means, connected to said condenser means, for converting liquified refrigerant to a liquid/vapor refrigerant mixture; and
evaporator means, connected to said expansion means and said container means, for converting liquid/vapor refrigerant mixture to spent refrigerant vapor in response to heat transfer to said evaporator means.

6. A downhole tool as defined in claim 5, wherein said condenser means is responsive to heat transfer from said condenser means to a well bore fluid.

7. A downhole tool as defined in claim 1, wherein said container means includes a first chamber, a second chamber, and a third chamber, said first chamber having refrigerant disposed therein and said second chamber having biasing means disposed therein and said third chamber adapted to receive well bore fluid.

8. A downhole tool as defined in claim 7, wherein said biasing means is pressurized gas.

9. A downhole tool, comprising:
a housing having a flow path defined therein for communicating said housing with an oil or gas well;
a valve disposed in said housing to control fluid flow through said flow path;
valve operating means, connected to said valve, for operating said valve, said valve operating means including electrical means for generating one or more local control signals to operate said valve both in response to one or more remote control signals generated at the surface of the oil or gas well and received down in the well by said valve operating means and in response to said electrical means being maintained down in the well at a temperature within a predetermined temperature operating range; and
cooling means for reducing temperature adjacent said electrical means down in the well so that said electrical means is maintained at a temperature within the predetermined temperature operating range.

10. A downhole tool as defined in claim 9, wherein said cooling means includes:
container means for holding a refrigerant in said downhole tool;
heat transfer means for conducting refrigerant from said container means in proximity to said electrical means so that a temperature adjacent said electrical means is within the predetermined temperature operating range for said electrical means; and
means for moving refrigerant from said container means through said heat transfer means.

11. A downhole tool as defined in claim 10, wherein:
said heat transfer means includes a valve; and
said downhole tool further comprises means for operating said valve of said heat transfer means in response to the temperature adjacent said electrical means.

12. A downhole tool as defined in claim 11, wherein said means for operating said valve of said heat transfer means includes a temperature sensor disposed in heat sensing proximity to said electrical means.

13. A downhole tool as defined in claim 10, wherein said heat transfer means is connected to said container means so that refrigerant moved through said heat transfer means returns to said container means.

14. A downhole tool as defined in claim 10, wherein said heat transfer means includes:
condenser means, connected to said container means, for converting a vaporized refrigerant to a liquified refrigerant;
expansion means, connected to said condenser means, for converting liquified refrigerant to a liquid/vapor refrigerant mixture; and
evaporator means, connected to said expansion means and said container means, for converting liquid/vapor refrigerant mixture to spent refrigerant vapor in response to heat transfer to said evaporator means.

15. A downhole tool as defined in claim 14, wherein said condenser means is responsive to heat transfer from said condenser means to a well bore fluid.

16. A downhole tool as defined in claim 10, wherein said container means includes a first chamber, a second chamber, and a third chamber, said first chamber having refrigerant disposed therein and said second chamber having biasing means disposed therein and said third chamber adapted to receive well bore fluid.

17. A downhole tool as defined in claim 16, wherein said biasing means is pressurized gas.

18. A downhole tool as defined in claim 9, wherein said flow path communicates with a flow path of a tubing string in response to said housing being connected to said tubing string.

19. A downhole tool as defined in claim 18, wherein said electrical means includes a microprocessor adapted for responding to said one or more remote control signals and for generating said one or more local control signals to perform a pressure buildup and drawdown test.

20. A downhole tool, comprising:
an apparatus including an electrical member;

a container having a chamber;

a refrigerant disposed in said chamber;

a condenser having an outlet and further having an inlet connected in communication with said chamber;

an expansion valve having an outlet and further having an inlet connected to the outlet of said condenser; and an evaporator having an inlet connected to the outlet of said expansion valve and having an outlet connected in communication with said chamber, said evaporator disposed for transferring heat from adjacent said electrical member.

21. A downhole tool as defined in claim 20, further comprising means for moving said refrigerant from said chamber through said condenser, expansion valve and evaporator and back into said chamber in response to pressure of fluid in a well.

22. A downhole tool as defined in claim 21, wherein said means for moving includes a piston slidably disposed in said chamber.

23. A downhole tool as defined in claim 22, wherein:

said container further includes a second chamber and a third chamber defined therein, said piston also slidably disposed in said second and third chambers and said third chamber adapted for communicating with fluid in the well; and said downhole tool further comprises biasing means, disposed in said second chamber, for providing a biasing force against said piston in opposition to pressure of the fluid communicated into said third chamber.

24. A downhole tool as defined in claim 23, wherein said container further includes a fourth chamber defined therein between said second and third chambers.

25. A downhole tool as defined in claim 24, wherein said means for moving further includes two check valves carried on said piston in said fourth chamber, each of said check valves having a respective actuating member for engaging said container near a respective limit of movement of said piston.

26. A downhole tool as defined in claim 23, wherein said biasing means includes a pressurized gas.

27. A method of reducing temperature adjacent an electrical portion of a downhole tool, comprising:

discharging a refrigerant from a chamber in the downhole tool in response to pressure of a fluid in a well so that refrigerant flows from the chamber through an expansion valve and an evaporator; and transferring to refrigerant passing through the evaporator heat from adjacent the electrical portion of the downhole tool.

28. A method as defined in claim 27, wherein discharged refrigerant also flows through a condenser for transferring heat from refrigerant passing through the condenser and wherein after passing through the evaporator discharged refrigerant returns to the chamber for reuse.

29. A method as defined in claim 27, wherein discharging a refrigerant includes moving a piston within the chamber of the downhole tool.

30. A method as defined in claim 27, wherein discharging a refrigerant includes moving a piston within the downhole tool against refrigerant in the chamber and against a pressurized gas in a second chamber of the downhole tool.

31. A method as defined in claim 27, wherein discharging a refrigerant includes opening the expansion valve in response to a temperature adjacent the electrical portion of the downhole tool exceeding a predetermined magnitude.

* * * * *